United States Patent [19]

Burkhart

[11] 4,240,871

[45] Dec. 23, 1980

[54] PAPER FORMING ROLL CONSTRUCTION

[75] Inventor: James H. Burkhart, Monroe, Ohio

[73] Assignee: Diamond International Corporation, New York, N.Y.

[21] Appl. No.: 40,012

[22] Filed: May 17, 1979

[51] Int. Cl.[3] ..... D21F 1/60

[52] U.S. Cl. ..... 162/274; 162/276; 162/357

[58] Field of Search ..... 162/274, 276, 300, 304, 162/369, 370, 371, 199, 279; 262/318, 357

[56] References Cited

U.S. PATENT DOCUMENTS

| | | | |
|---|---|---|---|
| 2,509,296 | 5/1950 | Goldsmith | 162/370 |
| 2,680,996 | 6/1954 | Brown | 162/370 |
| 2,772,606 | 12/1956 | Kelly | 162/276 |
| 3,111,454 | 11/1963 | Tucker et al. | 162/357 |
| 3,265,559 | 8/1966 | Means | 162/276 |
| 4,058,435 | 11/1977 | Williams | 162/370 |
| 4,139,412 | 2/1979 | Printz | 162/276 |

FOREIGN PATENT DOCUMENTS

| | | | |
|---|---|---|---|
| 213135 | 10/1966 | Sweden | 162/357 |

*Primary Examiner*—Peter Chin

*Attorney, Agent, or Firm*—Karl W. Flocks

[57] ABSTRACT

Paper forming roll comprising: a stationary pressure box; a rotatable foraminous shell extending around the box; paper making wire; spacing members extending between the box and shell, the spacing members being secured to the box; a plurality of circumferentially extending zones defined by the box, the shell, and the spacing members; wherein a first one zone is a forming zone, a second zone is a primary holding zone, a third zone is a transfer zone, and at least a fourth zone is a secondary holding zone; the box including a plurality of external and internal walls defining a plurality of pressure chambers, a first one of the external walls including ports providing communication between the forming zone and a first one of the pressure chambers from which vacuum for forming purposes may be achieved, a second one of the external walls extending generally vertically from one end of the first one of the external walls to partially define the primary holding zone, the generally vertical wall also including ports providing communication between the primary holding zone and a second one of the pressure chambers; and a drip element extending generally parallel to the generally vertical wall from a circumferential extension of the first one of the external walls adjacent the upper end of the generally vertical wall whereby water containing fibers finding its way into the primary holding zone past the spacing members dividing the forming zone and the primary holding zone will readily fall with fibers entrained therein to the lower inner surface of the shell without impinging upon or adhering to the pressure box.

24 Claims, 11 Drawing Figures

PAPER FORMING ROLL CONSTRUCTION

BACKGROUND OF THE INVENTION

1. Field of the Invention

The invention disclosed herein and for which applicant seeks letters patents relates generally to improvements in paper forming roll construction and mechanisms in combination therewith which, if patented, should be found with art in various subclasses of Class 162 in the United States Patent Office. More particularly, this invention relates to a paper forming roll of the type comprising a plurality of zones of operation with features which engender improved cleaning action, seal life, and longer trouble free operation together with production of an improved product.

2. Description of the Prior Art

Insofar as the prior art is concerned, applicant is cognizant of only a limited number of patents which might merit consideration in the prosecution of any patent application based upon subject matter disclosed and/or claimed herein. Foremost in relevance as prior art in applicant's opinion is the Printz U.S. Pat. No. 4,139,412 based upon application Ser. No. 792,750, filed May 2, 1977 and scheduled to be issued on Feb. 13, 1979. The structure disclosed in the Printz patent is in fact the precursor of that which is disclosed herein. The Printz patent discloses, inter alia, a foraminous forming roll comprising a plurality of circumferential zones of operation defined by a plurality of spacer or divider elements and a centrally located core member on which the divider elements are mounted. A sectional view of the roll of the Printz patent shows that the core member in contrast to the corresponding member of the instant application is cylindrical and further does not exhibit several other structural features present in the roll construction disclosed in the instant application.

SUMMARY OF THE INVENTION

Broadly, the invention disclosed herein provides new and improved paper forming roll construction of the type for use in paper forming machines.

More particularly, it is an object of this invention to provide a paper forming roll with such improved pressure box construction as to minimize fiber deposition problems.

It is another object of this invention to provide a paper forming roll in which structure is incorporated to enhance its ability to release fibers from its interior over that of prior art rolls.

It is a further object of this invention to reduce leakage of air and water between internal zones of operation of the pressure box or shell of a forming roll over that of the knwon prior art rolls by use of new and improved sealing arrangements.

It is yet another object of this invention to provide a paper forming roll with a pressure box configuration which substantially eliminates surfaces tending to entrap fibers which may then dry and slough off to contaminate the shell and consequently impair effective use of sealing elements.

It is still another object of this invention to provide a new and improved drainage system directly behind the external cleaning shower to reduce the dewatering and drying of internal fibers washed clear of holes in the shell which in the prior art shells would be dewatered, accumulate, and adhere to the shell to impair effective use of sealing elements.

It is moreover an object of this invention to provide a paper forming roll with seal holding members imparting minimum friction between the sealing element and the shell so that the sealing element may more easily conform to and compensate for surface irregularities in the shell to provide effective sealing.

It is an additional object of this invention to provide a paper forming roll with a sealing element featuring a lighter and more flexible shoe element than comparable prior shoe elements to effect and maintain improved contact thereof with the shell surface whereby improved water holding capabilities in the holes in the shells is attained after sheet transfer.

CONSIDERATION OF LIMITATIONS ENCOUNTERED IN USE OF EARLIER FORM OF THE PRESENT INVENTION

Figure 8:
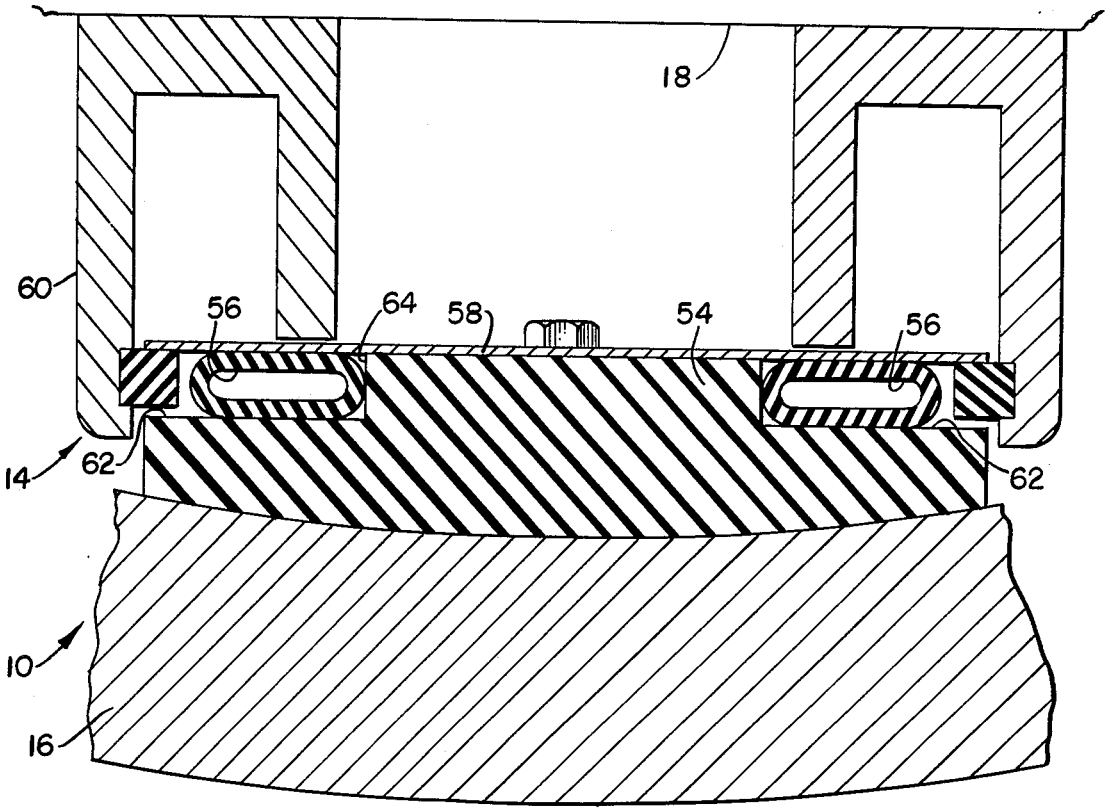
FIG. 8 is a vertical sectional view on an enlarged scale of the large seal in the forming roll illustrated in FIGS. 4 and 5.
Figure 11:
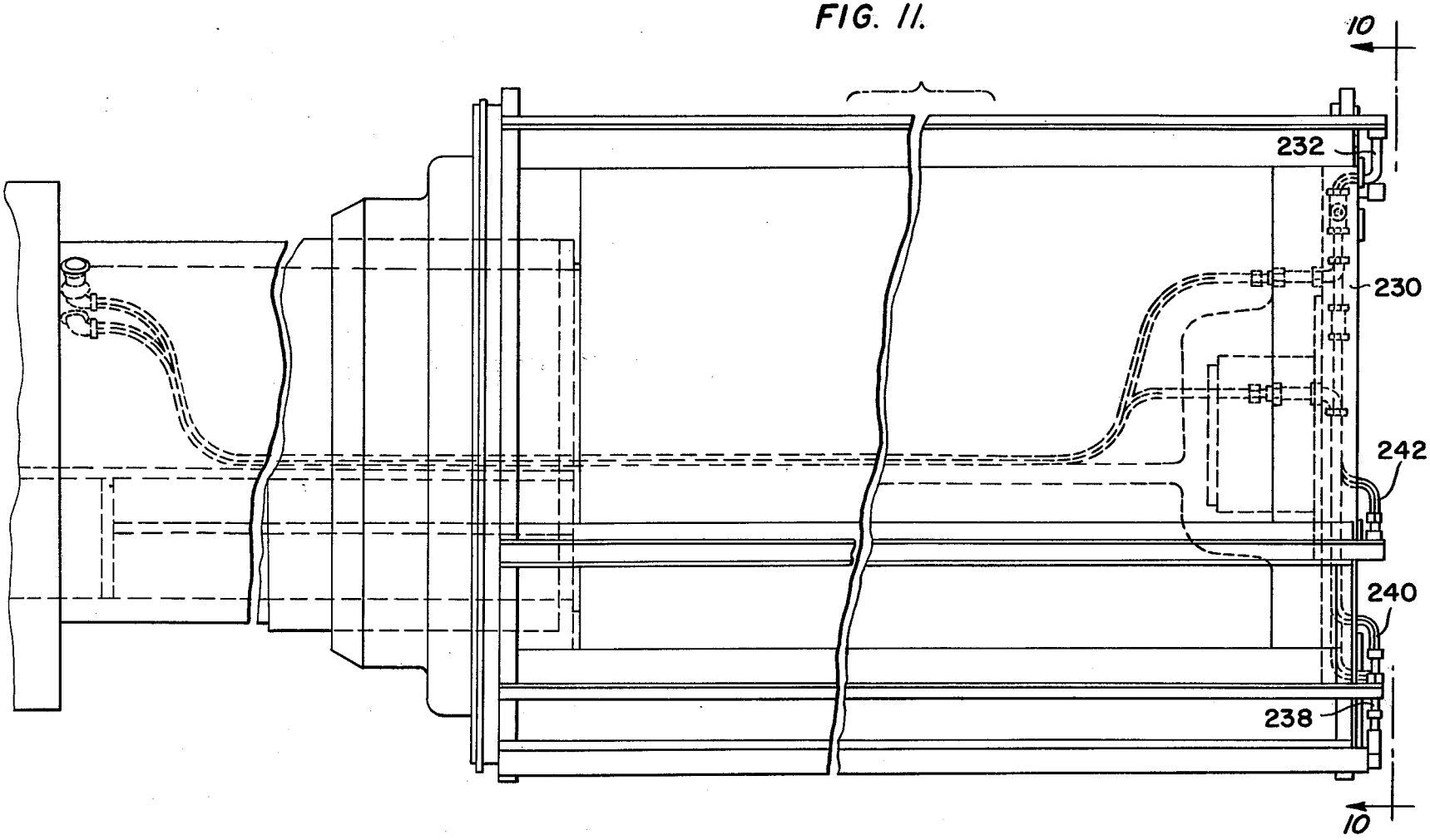
FIG. 11 is a side elevational view of the assembled paper forming roll according to the disclosed invention (with portions broken away and omitted) to show the supply lines for loading the seals thereof.

Due consideration of the structural details and functional features of the precursor of the inventive concepts set forth herein will lead to a thorough understanding of applicant's invention. Giving effect to the foregoing, the reader must turn to FIGS. 4 and 5 which show details of the internal parts of the precursor paper forming roll 10 to the machine constituting applicant's invention and to FIGS. 8 and 11 showing details of sealing units 12 and 14 used in the precursor roll 10.

Figure 4:
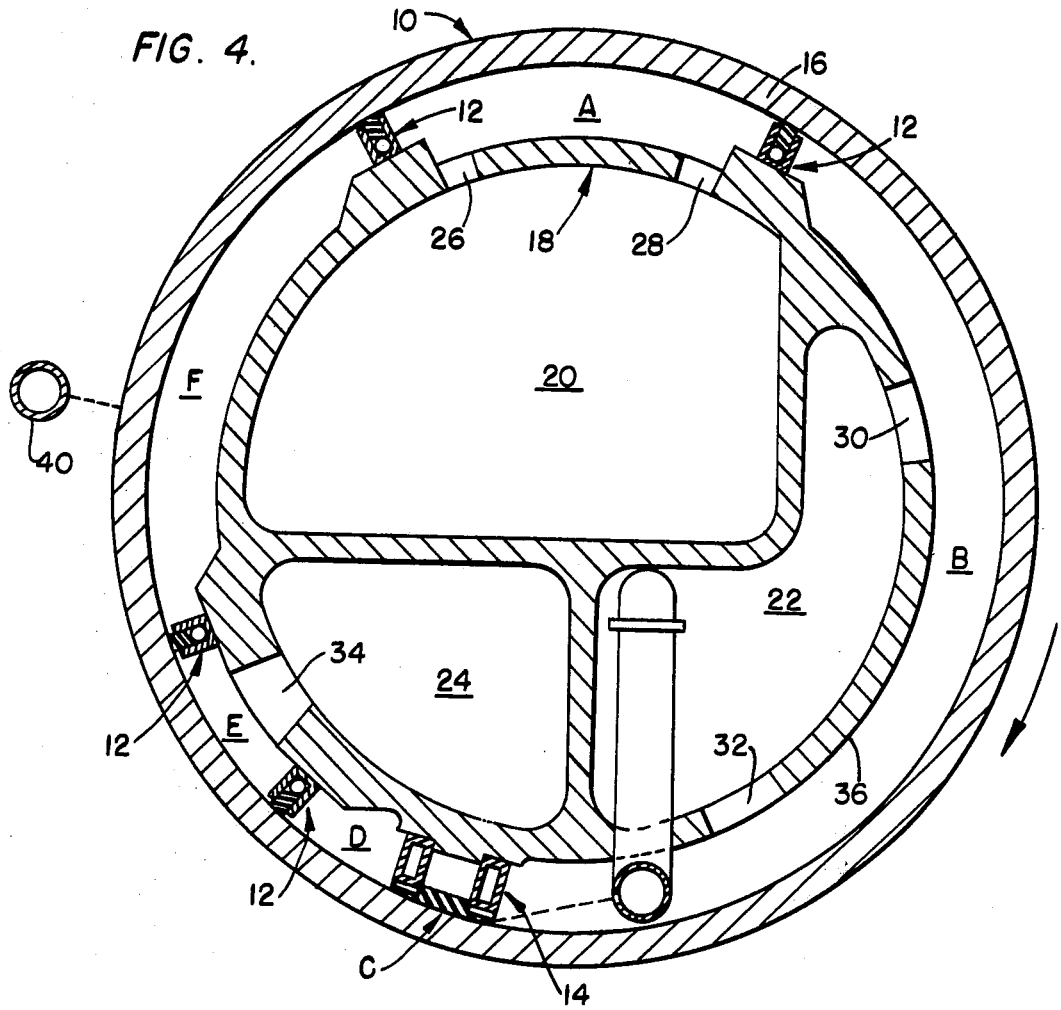
FIG. 4 is a sectional view similar to FIG. 3 of a precursor forming roll used in machinery manufactured by assignee of the present invention showing initial use thereof.

With the above in mind and looking closely at FIG. 4 the reader should understand that, as illustrated, roll 10 is in new or clean condition and comprises a rotatable shell 16 which preferably is a metal roll perforated with drilled holes to allow the storage and passage of water from a wet ply of paper formed on a paper making wire mesh closely contacting the outer circumference of the shell 16. Another main part of the forming roll 10 is a stationary pressure box 18 which provides a structural member on which all other internal parts are mounted and additionally provides an internal network of pressure chambers 20,22,24 through which air or water may pass whether vacuum or pressure is supplied therein. Attached at the rear of the pressure box 18 is a suction journal which connects the various chamber 20,22,24 with the outside of the forming roll 10. Pressure box 18 also includes ports 26,28,30,32,34 in the outer wall 36. Mounted on outer wall 36 are four similar sealing units 12 and a larger sealing unit 14. The sealing units 12 and 14 extend between pressure box 18 and shell 16 to define various zones of operation A,B,C,D,E,F. Ports 26 and 28 are to be understood to provide vacuum communication from chamber 20 to zone A, while ports 30 and 32 are to provide vacuum communication from chamber 22 to zone B, and port 34 is to provide positive pressure communication from chamber 24 to zone E. Outside the forming roll 10 is a needle cleaning shower 40 used to clean the paper making wire mesh and holes in the shell 16.

Figure 5:
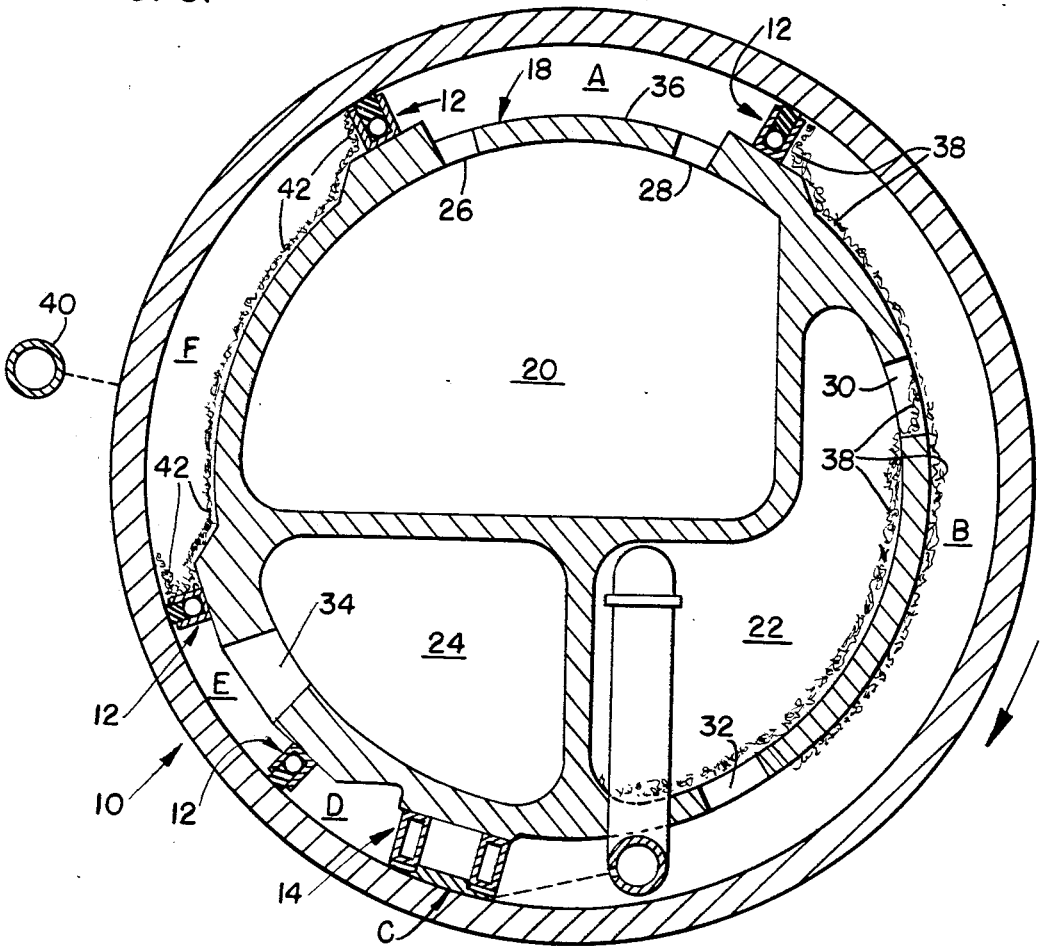
FIG. 5 is a sectional view similar to FIG. 4 of the precursor roll in use after use thereof over an extended period of time.

FIG. 5 shows how drops or sprays of fiber 38 containing water gravitate from the upper right sealing unit 12 over the surface of pressure box 18, enter port 30, and drop out of port 32. The fiber 38 in the drops or spray tend to adhere to the surfaces of pressure box 18 and subsequently dewater and also dry out in periods when the forming unit is not operating and no water is in contact with the fiber deposits 38 indicated on the surfaces of pressure box 18. From time to time during periods of operation, fairly large lumps of fiber deposits 38 tend to slough off and drop directly on to the internal circumference of shell 16 or indirectly through the port 32. Deposits 38 inside the pressure box 18 occurs when fiber containing water runs through the upper port 30.

When the deposits 38 drop off, they are conveyed by the rotation of the shell 16 to the sealing unit 14 where they can lift the unit 14 and allow the release of water stored in the shell 16 at the time of transfer of the web from the wire mesh to the carrier fabric or felt. Such release of water from shell 16 is objectionable in that excessive water released from the shell 16 at time of transfer can ruin the web of paper that is produced.

Also shown in FIG. 5 is a deposit of fibers 42 on outer wall 36 in zone F. When needle shower 40 washes out fibers trapped in the wire mesh or holes in the shell 16, some of these fibers 42 may adhere to the internal circumference of shell 16 and be conveyed up to the upper left sealing unit 12 separating zone F from zone A and some of the fibers 42 may pass this sealing unit 12 in the holes of shell 16 enter zone A, pass through ports 26 or 28 into chamber 20, and be released to the outside of the forming roll 10 from chamber 20 through a suction journal. However, a substantial amount of the fibers 42 may become entrapped again in the holes of the shell 16 and become wedged between any of the four sealing units 12 or the sealing unit 14 and the shell 16 resulting in improper operation of the roll 10. Fibers 42 may be wiped from the shell 16 at sealing unit 12 following zone F and dropped down to the pressure box 18 and subsequently roll down to become an accumulation on top of sealing unit 12 at the beginning of zone F where the fibers 42 may again adhere to the internal surfaces of shell 16 where the process is repeated with subsequent aggravation of the condition.

In addition to the fiber deposit 42 accumlation process in zone F as described previously, another process occurs which further causes deposit accumulation. Water enters zone F whenever the holes in the shell 16 pass in front of the needle shower jet 40. This shower water upon entering zone F contains some fibers 42 which have been picked up in the holes in the shell 16 not otherwise deposited as explained previously. The water strikes the surface of pressure box 18 and runs down the surface to the lower sealing unit 12 of zone F where it runs back into the holes in shell 16. This water may then redeposit its load of fibers 42 on the inside of the holes or wire mesh on shell 16 which defeats the purpose of the shower 40. As zone F is not connected to the outside of the forming roll 10, deposits of fibers 42 continue to build up and may become increasingly heavy as the period of operation progresses. When the forming roll 10 is shut down, the deposit 42 will dry out and after start-up, the dry hardened bundles of fiber 42 may contribute to increased occasions of malfunction of sealing units 12 and/or 14.

Additional consideration of the structural details of forming roll 10 reveals further that sealing unit 14, as may be seen more clearly in FIG. 8, comprises a sealing element 54 biased into sealing engagement against shell 16 by means of pneumatically inflatable tubular members 56,56 disposed between and pushing against a reaction member 58 and sealing element 54. Reaction member 58 functions to transfer the pressure of sealing element 54 against shell 16 to the holder 60, which is affixed to pressure box 18. From a careful study of FIG. 8 the reader will readily see that sealing element 54 comprises an axially extending recess 62 on each side of a radially inwardly extending tongue 64 on the inner radial surface. As assembled tongue 64 is disposed with its inner edge against reaction member 58 and each recess 62 receives a tubular member 56. The reader may also readily discern from a careful study of FIG. 8 that the sealing element 54 is considerably larger than each tubular member 56 both in terms of the respective circumferential widths and in terms of the respective radial thicknesses thereof. At this juncture it is noted that sealing element 54 is made of high molecular weight polymeric material so that considerable air pressure is required in tubular members 56 to effect an accurate and precise sealing relationship between sealing element 54 and shell 16 in view of the relative differences between the dimensions of the sealing element 54 and the tubular memebers 56. Also, it is noted that the rigidity of the sealing element 54 is so great that it does not readily bend or deflect to conform to the internal surface of shell 16 even at significantly higher air pressures in the tubular members 56.

DESCRIPTION OF THE INVENTION

Figure 1:
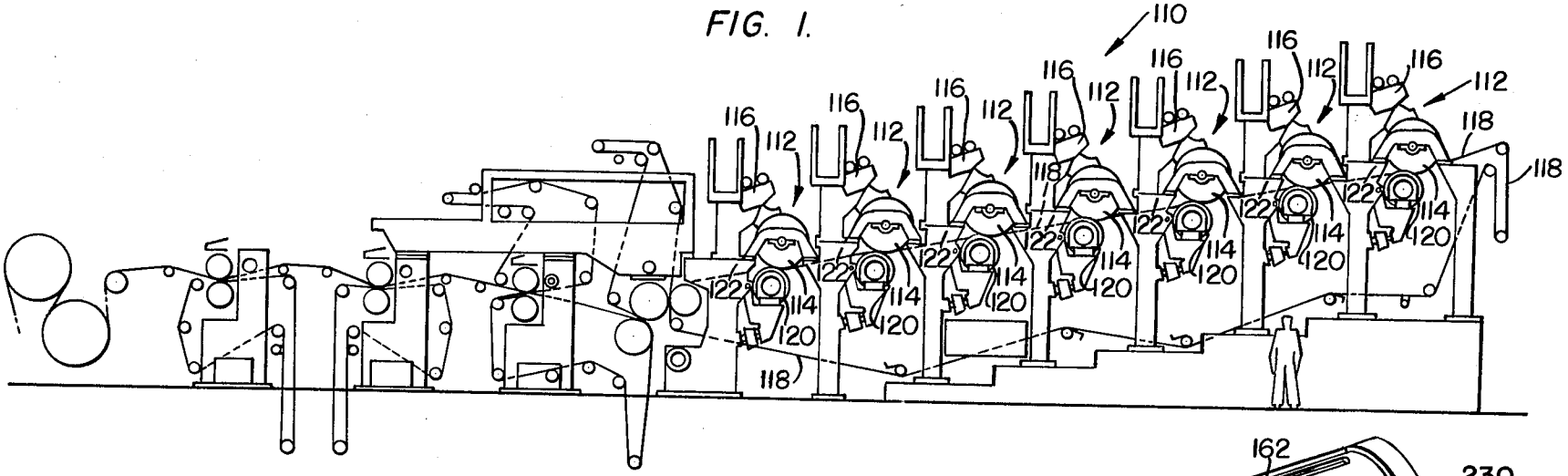
FIG. 1 shows a side elevational view of a multi-ply paper forming machine incorporating the improved forming roll construction disclosed herein.
Figure 2:
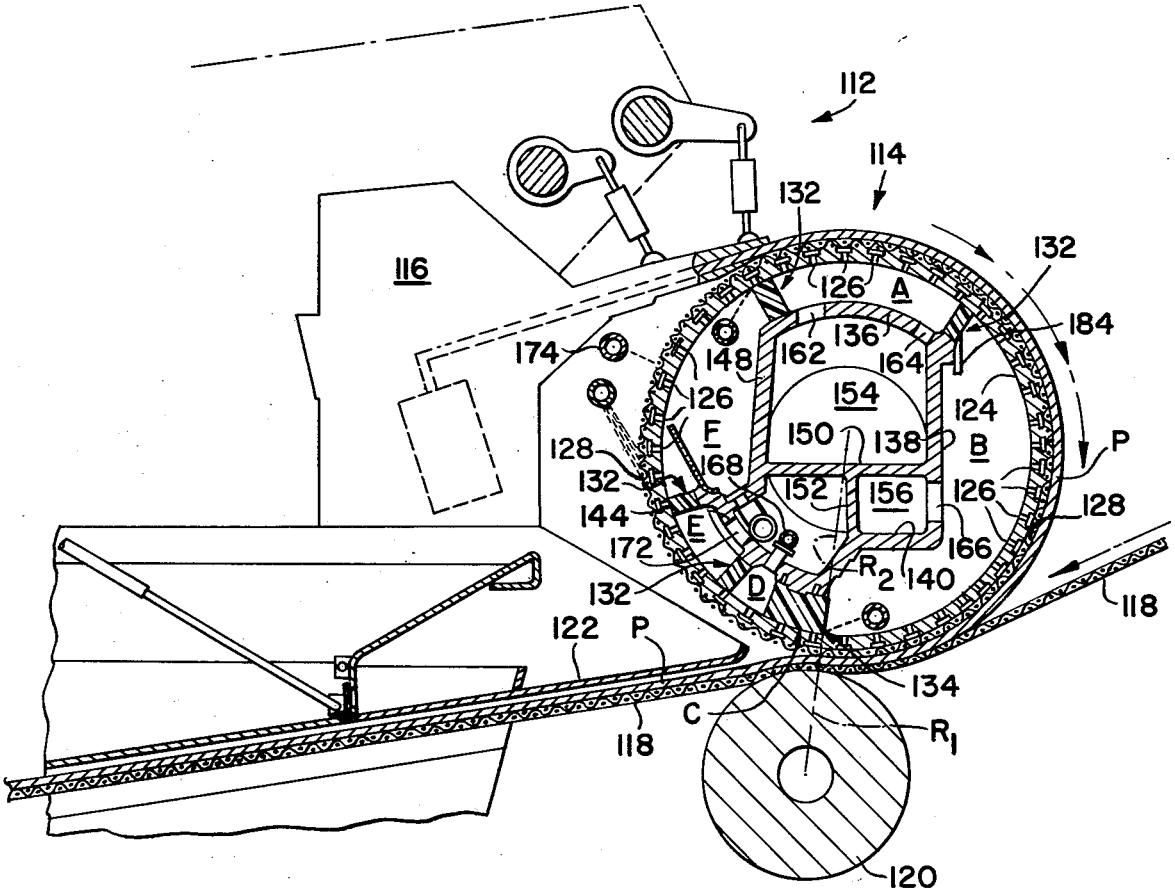
FIG. 2 is a vertical section view on an enlarged scale taken through one of the paper forming rolls and elements immediately associated therewith in FIG. 1.

To obtain improved results in use of the multi-ply paper forming machine 110, illustrated in FIG. 1 and for which the assignee of the instant application has obtained U.S. Pat. No. 4,139,412 mentioned through the patentee Printz, applicant has developed the improved paper forming roll and accessories thereof illustrated in FIGS. 2, 3, 6, 7, and 9 for use in place of the precursor forming roll and accessories illustrated in FIGS. 4, 5 and 8 and discussed above. Looking carefully now at the drawings the reader should appreciate that a sectional view of one of the forming units 112 of FIG. 1 is illustrated in FIG. 2. Each forming unit 112 includes a forming roll 114 and a head box 116. Also provided in the forming machine 110 a common porous or foraminous belt-like carrier in the form of a continuous transfer felt, wire, or fabric carrier 118; a couch roll 120, and catch pan unit 122 for use with each forming roll 114. The forming roll 114 as can be clearly seen in FIG. 2 comprises a rotating shell 124 with drilled holes 126 and face wire 128. While these holes 126 and the face wire 128 are omitted from the shell 124 in FIG. 3, such omission is to be understood to be for ease of illustration only and that such holes 126 and face wire 128 are to be present in the actual construction and assembly of the forming roll 114.

Figure 3:
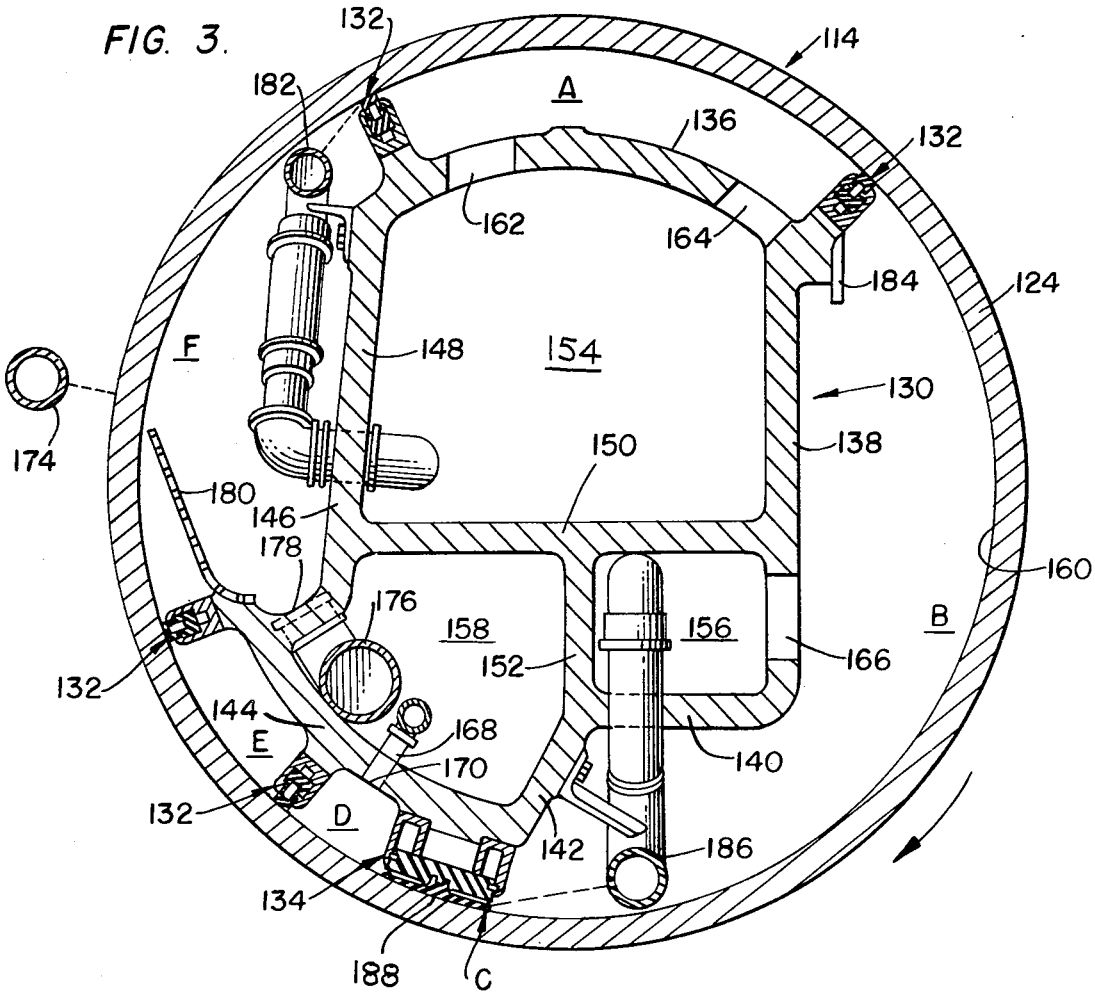
FIG. 3 is a section view similar to FIG. 2 but on an even larger scale, taken at a different location along the length of the paper forming roll with some details omitted and others illustrated.
Figure 6:
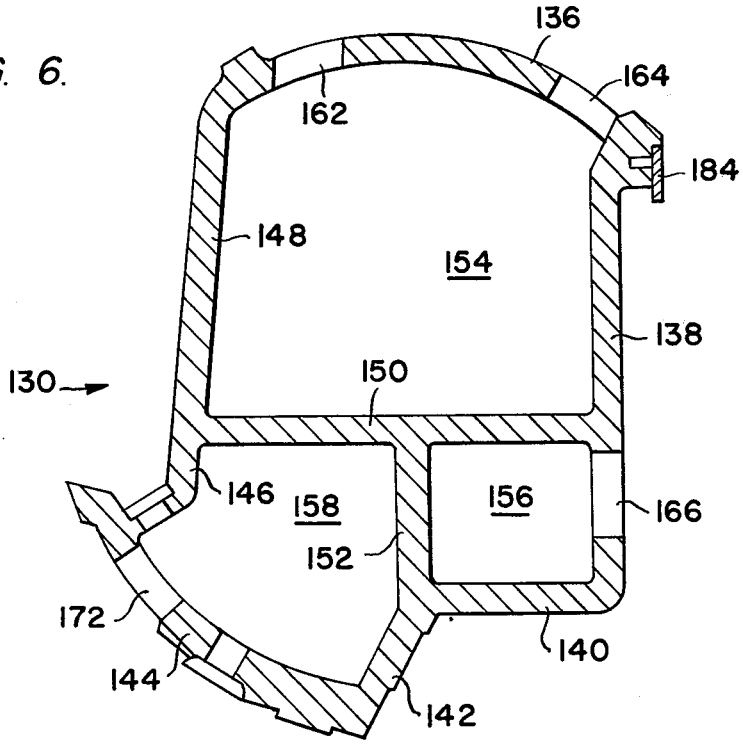
FIG. 6 is a vertical sectional view of the pressure box core of FIG. 3 at a slightly different location along the length thereof prior to installation in and assembly with the roll shell.

As may be seen in FIG. 2 and more clearly in FIG. 3 the forming roll 114, according to the present invention, comprises a new and improved pressure box 130, new and improved spacing devices or sealing units 132,134. For a better appreciation of the new and improved pressure box 130 reference should be made to FIGS. 6 and 7 as well as to FIGS. 2 and 3. The general diametric dimension of the pressure box 130 can be appreciated from the outline of a person of average height standing to the left of the broken end of pressure box 130 in FIG. 7. Further with respect to the size of pressure box 130, it is noted that its length is on the order of 19 to 20 feet in one construction thereof. Pressure box 130, as may best be appreciated from FIG. 3 comprises a plurality of external walls 136,138,140,142,144,146,148 and a plurality of internal walls 150,152. Pressure box 130 in operation is stationary with sealing units 132,134 secured thereto and shell 124 rotatable around pressure box 130 in the direction of the arrow in FIG. 3. As illustrated in FIG. 6 the various external walls 136,138,140,142,144,146,148 and internal walls 150,152 define three pressure chambers 154,156,158. External walls 136,138,140,142,144,146,148 together with sealing units 132,134 and the inner surface 160 of shell 124 define a plurality of circumferentially extending zones A,B,C,D,E,F. From FIG. 2 it can be seen that sealing unit 134 occupies the entire space of zone C which is on a line drawn between the centers of shell 124 and couch roll 120. Also as can be seen from FIG. 2 stock from head box 116 is deposited on the face wire 128 at the left side of zone A which is the forming zone. External wall 136 is formed with two sets of ports 162,164 which provide communication between pressure chamber 154 and zone A to effect vacuum or suction in zone A. It is to be understood that pressure chamber 154 is connected to a controllable vacuum source axially of pressure chamber 154 at one end thereof whereby water may be drawn into wire 128 and holes 126. Zone B is a primary holding zone over which the paper P is held on wire 128 and water may be held in holes 126. Zone B, which extends from the sealing unit 132 at the one o'clock position of FIG. 3 to the sealing unit 134, is defined in part by external walls 138,140, and 142 of pressure box 130. Of significance is the fact that external wall 138 is generally vertical and that external walls 140 and 142 which are at or below the lower end of external wall 138 are set inwardly therefrom toward the horizontal center of pressure box 130 with this arrangement being of significance for the reason that any fiber or fiber carrying water reaching the interior of shell 124 and getting past the sealing unit 132 at the one o'clock position of FIG. 3 so that pressure box 130 will provide a minimum of or no surface on which fibers may impinge, adhere, accumulate, dry, and from which to later fall and cause malfunction. Vacuum or suction is established in zone B by way of ports 166 formed in the lower portion of wall 138 to establish communication between zone B and pressure chamber 156. Chamber 156, like chamber 154, is connected to a controllable vacuum source at one end thereof.

Zone C in operation functions as a transfer or couching off zone in the manufacture of paper. Considering the structural details of both FIGS. 2 and 3, the reader should understand that couch roll 120 forms a pressure nip with shell 124 in zone C with carrier 118 and paper P passing therebetween, that zone C lies on the aligned radii $R_1$, $R_2$ which relate to the pressure nip or contact of couch roll 120 and shell 124, respectively, and that sealing unit 134 is disposed over the entire transfer zone C. This is not to say that zone C extends over the entire circumferential width of sealing unit 134, but rather that sealing unit 134 extends over the entire circumferential width of transfer zone C.

Zone D as can be seen in FIG. 3 extends between sealing unit 134 and the next sealing unit 132 in the clockwise direction therefrom. Zone D is a secondary holding zone operable at low speeds of operation such as at 200 to 300 feet per minute of shell 124 to hold water on wire 128 and in holes 126. Negative pressure or suction is provided in zone D by pipe 168 with orifice 170.

Figure 7:
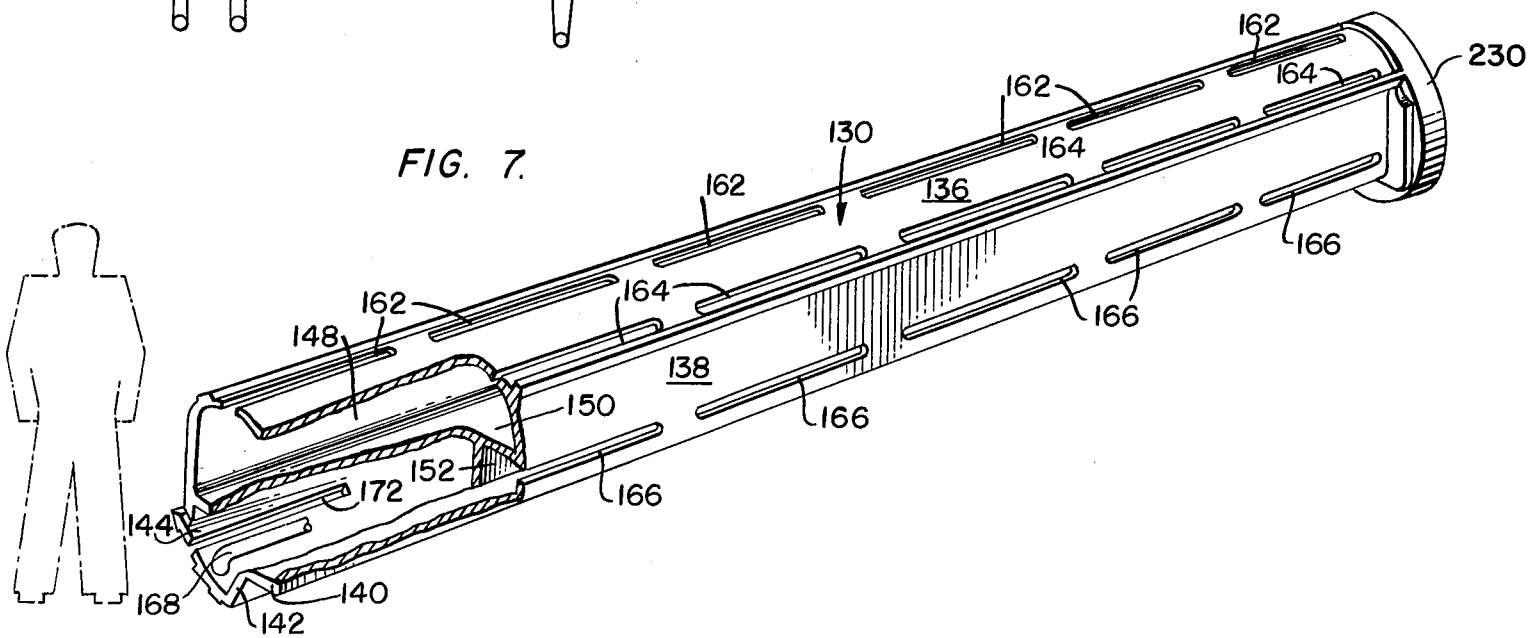
FIG. 7 is a view in perspective of the pressure box core of FIG. 6 on a reduced scale and with portions thereof broken away.

Zone E constitutes a water release zone between the two sealing units 132 after sealing unit 134 in the clockwise direction in FIG. 3. Positive pressure is furnished to zone E from pressure chamber 158 by port 172 in external wall 144 as shown in FIGS. 2 and 7. The positive pressure provided in zone E serves the function of purging water, stray fibers or the like which may be left in the holes 126 and the wire 128 on shell 124 before that portion of shell 124 continues to the forming portion of the paper making cycle.

After zone E in the clockwise direction in FIG. 3 shell 124 is subjected to a high pressure shower in zone F wherein a water source 174 placed outside of shell 124 applies a needle spray which blasts any fibers in holes 126 or wire 128 inwardly of shell 124 into zone F, these fibers can drop into a drain or sewer pipe 176 having one or more openings 178 in the bottom of zone F. Pipe 176 for convenience is located in pressure chamber 158 and extends axially therethrough to discharge at one end of pressure box 130. To prevent fibers forced inwardly of shell 124 by the needle spray from source 174 from collecting on the sealing unit 132 in the eight o'clock position in FIG. 3, a baffle 180 adjacent that particular sealing unit 132 is provided so as to extend upwardly thereover at an incline from a lower edge supported on wall 144 at an area just above openings or passages 178 to an upper edge in close proximity to the inner surface of shell 124 to the vicinity of the area of maximum radial width of zone F so that fibers falling thereon will be directed to openings 178. The cleaning operation in zone F is augmented by a shower 182 to wash off any fibers sticking to the inside surface 160 of shell 124 after having been washed inwardly out of holes 126 by the needle spray from water source 174.

Further in connection with zone B in which pressure box 130 has been described above as including a generally vertical wall 138 with a minimum surface on which fibers may accumulate, the pressure box 130 is provided with means which is referred to as a drip lip 184. Drip lip 184 may be formed as an integral part of or as a separate part and attached to pressure box 130. Drip lip 184 as assembled or formed on pressure box 130 is to extend for the full axial length of pressure box 130 and also generally parallel to generally vertical wall 138. As can be seen in FIG. 3 drip lip 184 is spaced horizontally away from the center of pressure box 130 at a greater distance than generally vertical wall 138 is, just slightly below the sealing unit 132 at the one o'clock, and extending from a shoulder like circumferential projection from arcuate wall 136 of pressure box 130. The structure of drip lip 184 as thus described is a generally vertical surface from which water containing fibers passing through sealing unit 132 at the one o'clock position of FIG. 3 immediately ahead of drip lip 184 will readily drop while these fibers are still in suspension from the bottom edge of drip lip 184 and fall directly to the inside surface 160 of shell 124 without contacting pressure box 130 and leaving a fiber deposit. Any fibers which may happen to enter port 166 might be deposited to a slight extent in chamber 156 but generally will be removed axially therefrom under suction pressure. Of significance is the fact that there will be no larger deposits of fiber to be dried in zone B when the forming roll 114 is idle to later cause malfunction of sealing unit 134. Further, in this regard it is noted that external wall 140 on the underside of pressure chamber 156 is not provided with any port such as port 32 in the pressure box 18 of precursor forming roll 10.

Figure 9:
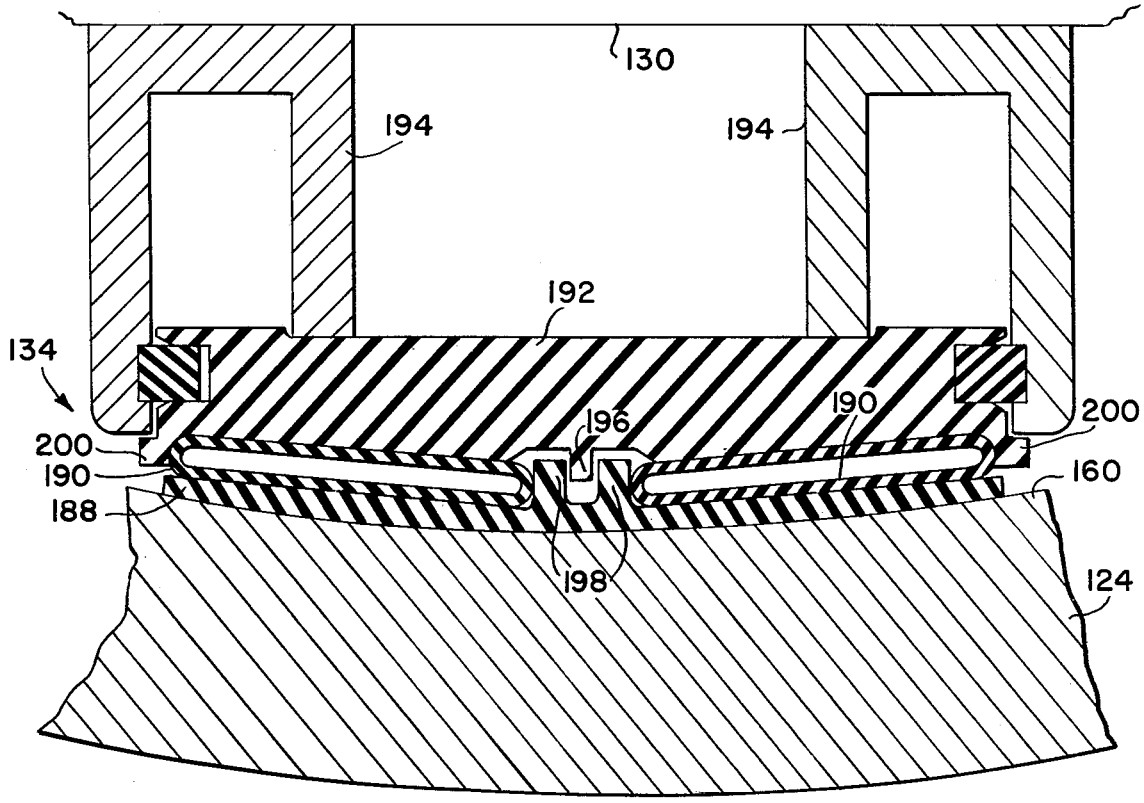
FIG. 9 is a vertical sectional view on an enlarged scale of the large seal in the forming roll illustrated in FIG. 3.

To ensure maximum operating efficiency of sealing unit 134 a water spray is directed thereat from pipe 186. Specifically, the water spray from pipe 186 is directed at the shoe or sealing element 188 of sealing unit 134 at the area where shell 124 initially comes into contact with sealing element 188. The reaction member 192 also has shoulders 200 at opposite edges thereof in contact with biassing means to restrict inflatable tubular members 190 within the circumferential expanse of reaction member 192. The sealing unit 134 as illustrated in FIG. 9 is in loaded condition with sealing element 188 against inner surface 160 of shell 124 by means of inflating tubular member 190 which push against reaction member 192 which positions and transfers the pressure of sealing element 188 against shell 124 to holder 194 affixed to pressure box 130. Sealing element 188 is seen to be of only slight radial thickness compared with that of reaction member 192. The inflatable tubular members 190 extend for substantially the entire circumferential length of sealing element 188 with the space occupied by ribs 196,198 not being co-extensive with tubular members 190. The thin and consequently flexible construction of sealing element 188 allows it to easily and readily conform to the inner surface 160 of shell 124 and provide effective sealing therebetween. Deviations from a perfectly contacting relationship between sealing element 188 and the inner surface 160 of shell 124 will be significantly less than would be obtainable if precursor sealing unit 14 were to be used since sealing element 54 is relatively heavy and massive compared to sealing element 188. Also, because inflatable tubular members 190 are relatively wide, they provide better pressure distribution and can be made very thin in comparison to that of tubular member 56. As both sealing element 188 and sealing element 54 are made of similar material, such as of high molecular weight polymer, machining of the larger sealing element 54 must be more accurate and precise to fit and seal properly against shell 16 since the rigidity of sealing element 54 is so great that it may not bend readily to conform to the inner surface of shell 16 even at significantly higher pressures in tubular members 56. In contrast to such limitations of sealing unit 14 illustrated in FIG. 8 the improved sealing unit 134 illustrated in FIG. 9 provides a unit that is more adaptable, easier to place in operation, more efficient and effective effective among other obvious advantages.

Figure 10:
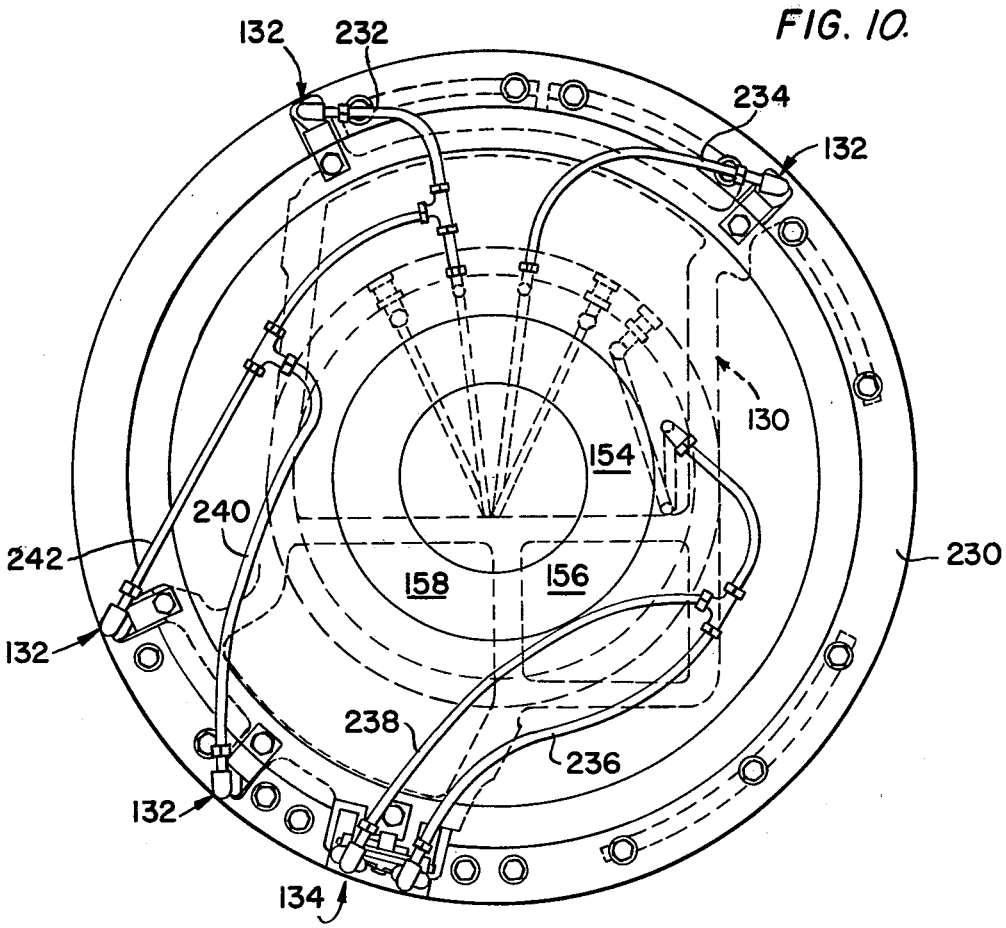
FIG. 10 is an elevational view of one end of an assembled paper forming roll according to the invention disclosed herein, looking from plane 10—10 in FIG. 11, for example, and shows pressure distributing hoses and coupling arrangements therefor which supply pressure to load the various seals therein.

From FIG. 7 it can be seen that pressure box 130 includes an end plate 230. Although only one end plate 230 is illustrated in connection with pressure box 130, it is to be understood that a second end plate is provided in the assembled condition of pressure box 130. The structure of end plate 230, however, is different from its counterpart at the opposite end of pressure box 130 in that end plate 230 includes fittings and valves for introducing air into and releasing air from sealing units 132 and 134 as may be appreciated in FIGS. 10 and 11. Hoses 232,234,240, and 242 which are connected to an air supply source, not illustrated, are seen in FIG. 10 to be connected to sealing units 132 in the locations indicated by the outline in phantom of pressure box 130. Air hoses 236,238, also connected to the air supply source not illustrated, can be seen to be connected to sealing unit 134 which includes two inflatable tubular members 190.

While forming roll 115 is shown in FIGS. 1 and 2 to be operable with a couch roll 120, it is to be understood that forming roll is readily adaptable and is intended to be combined with any known couching means.

OPERATION OF THE INVENTION

In an operative adaptation of the present invention a plurality of forming rolls 114 as described above are provided in an arrangement as illustrated in FIG. 1 for simultaneous operation as described in U.S. Pat. No. 4,139,412 to produce multi-ply paper. Considering details of FIG. 2 the reader will readily appreciate that operation of forming roll 114 is achieved by clockwise rotation thereof with stock being delivered on face wire 128 at the left edge of forming zone A. As shell 124 is rotated around stationary pressure box 130, water is drawn into paper making wire 128 and holes 126 in shell 124. As shell 124 is rotated to the sealing unit 132 at the one o'clock position the paper P moves into and through the primary holding zone B. As shell 124 approaches and then proceeds to zone C the transfer and crouching off zone, paper P comes into contact with and is supported by carrier 118. In reaching zone C the transfer and couching off zone, carrier 118 and paper P traverses colinear radii $R_1$,$R_2$ extending from the centers of couch roll 120 and forming roll 114, respectively, to the couching off point or point of tangency. Beyond zone C the carrier 118 and paper P move under a catch pan unit 122 while shell 124 with papermaking wire 128 moves to secondary holding zone D, water release zone E, and fiber removal or cleaning zone F, before moving to zone A for a new forming cycle. In the operation of forming roll 114 ports 162 and 164 provide vacuum in zone A from chamber 154 of pressure box 130, ports 166 provide vacuum communication in zone B from chamber 156, and ports 172 provide positive pressure in zone E from chamber 158 through ports 172. In zone B a slight vacuum is provided by pipe 168 at low speeds of operation to hold water on wire 128 and in holes 126 of shell 124.

Operation of paper forming machine 110 may include operation of all forming units 112 or only certain ones of the forming units 112 while others are kept idle.

With respect to the removal of fibers from zone F, it may be readily appreciated that stray fibers washed inwardly through shell 124 into zone F will be directed downwardly by baffle 180 away from the sealing unit 132 at the eight o'clock position in FIG. 3 and into through openings or bores 178 of interconnecting conduits extending through the portion of external wall 146 at the bottom of zone F and providing passage between zone F and drain pipe 176. As seen in FIG. 3 external wall 146 turns radially outwardly at the bottom of zone F to intersect external wall 144. Baffle 180 is sloping downwardly and inwardly toward openings 178 from the inner surface 160 of shell 124 functions as a ramp to funnel all fibers impinging thereon toward openings 178 and into drain pipe 176. Drain pipe 176 is represented in FIG. 3 to be disposed adjacent to the portion of external wall 146 at the bottom of zone F and to be extending for substantially the entire length of pressure box 130 and shell 124. Also, while FIG. 3 only shows a single through opening or bore 178, it is to be understood that a plurality of other openings 178 and conduits are provided in the assembly both in front of and behind the section through which FIG. 3 has been taken for purposes of illustration.

It will be obvious to those skilled in the art that various changes may be made without departing from the scope of the invention and therefore the invention is not limited to what is shown in the drawings and described in the specification but only as indicated in the appended claims.

What is claimed is:

1. Paper forming roll comprising:

(a) a stationary pressure box;

(b) a generally cylindrical rotatable foraminous shell extending around said box;

(c) paper making wire on the outside surface of said shell;

(d) spacing means extending radially from said box to said shell, said spacing means being secured to said box;

(e) a plurality of circumferentially extending zones defined by said box, said shell, and said spacing means, wherein a first one of said zones is a forming zone, a second one of said zones is a primary holding zone, a third one of said zones is a transfer zone, and at least a fourth one of said zones is a secondary holding zone for holding water during operation of said forming roll;

said box including a plurality of external walls and a plurality of internal walls defining a plurality of pressure chambers, a first one of said external walls including means providing communication between said forming zone and a first one of said pressure chambers from which vacuum for forming purposes may be achieved, a second one of said external walls extending generally vertically from one end of said first one of said external walls to partially define said primary holding zone, said generally vertical wall also including means providing vacuum communication between said primary holding zone and a second one of said pressure chambers; and drip means located in said primary holding zone and extending generally parallel to said generally vertical wall from a circumferential extension of said first one of said external walls in the immediate vicinity of the upper end of said generally vertical wall whereby water containing fibers finding its way into said primary holding zone past the spacing means dividing said forming zone and said primary holding zone will readily fall with fibers entrained therein to the lower inner surface of said shell without impinging upon or adhering to the pressure box.

2. Paper forming roll as defined in claim 1 wherein said spacing means comprise a plurality of circumferentially spaced, radially extending sealing units and wherein one of said sealing units is of significantly greater circumferential width than any other one of said other sealing units and occupies the entire space of said transfer zone within said cylinder between said box and the inner surface of said shell.

3. Paper forming roll as defined in claim 2 wherein said shell continuously rotates in a direction passing said forming zone first and thereafter said primary holding zone, said transfer zone, and said secondary holding zone at least in succession during paper forming operation of said cylinder; and said generally vertical wall includes an upper portion partially defining said first one of said pressure chambers and a lower portion partially defining said second one of said pressure chambers.

4. Paper forming roll as defined in claim 3 wherein said lower portion of said generally vertical wall includes one or more air entry ports to provide communication therebetween for effecting a vacuum in said primary holding zone through said second one of said pressure chambers with a vacuum source.

5. Paper forming roll as defined in claim 4, provided with means inside said shell for directing a water spray at said one sealing unit occupying the entire space of said transfer zone.

6. Paper forming roll as defined in claim 5 wherein said secondary holding zone includes means for supplying a low intensity vacuum thereto whereby water in the surface of said shell and said wire passing said transfer zone will be held in said shell and said wire at least until passing beyond said secondary holding zone.

7. Paper forming roll as defined in claim 6 wherein all of said circumferentially extending zones are limited circumferentially by at least two of said radially extending sealing units except for said transfer zone which is limited by said one sealing unit occupying the entire space thereof.

8. Paper forming roll as defined in claim 7 wherein said plurality of circumferentially extending zones includes a water evacuation zone and a fiber disposal zone following said secondary holding zone in succession, and a third one of said pressure chambers is connected to a source of pressure and includes air exit ports in communication with said water evacuation zone to supply positive pressure air therein for application against said rotatable shell passing thereby to force water outwardly from said shell.

9. Paper forming roll as defined in claim 8 wherein said fiber disposal zone includes a lower end and an upper end with first shower means disposed outside of said shell between said lower end and said upper end of said fiber disposal zone for washing away fiber residue and second shower means disposed within said fiber disposal zone adjacent said upper end thereof for washing down fiber residue not removed by said first shower means and sticking to the inside surface of said shell.

10. Paper forming roll as defined in claim 9 wherein means for receiving and draining water and fibers are disposed adjacent said lower end of said fiber disposal zone for substantially the entire length of said cylinder.

11. Paper forming roll as defined in claim 10 wherein a baffle is provided in said fiber disposal zone with an upper edge adjacent an area of said fiber disposal zone having maximum radial width and a lower edge inclined radially inwardly from said upper edge and supported on said stationary pressure box adjacent said means for receiving and draining water and fibers.

12. Paper forming roll as defined in claim 11 wherein said one sealing unit occupying the entire space of said transfer zone comprises a sealing element, biassing means, a reaction member, and holding means extending radially outwardly from and secured to said pressure box, said reaction member being held in a fixed radial position by said holding means, said sealing element being disposed radially outwardly of said reaction member, means extending radially outwardly from said reaction member cooperating with means extending radially inwardly from said sealing element to limit circumferential movement of said sealing element, said biassing means being disposed between said reaction member and said sealing element on opposite sides of said means limiting circumferential movement of said sealing element, said reaction member also having shoulders at opposite edges thereof in contact with said biassing means to restrict said biassing means within the circumferential expanse of said reaction member.

13. Paper forming roll as defined in claim 12 wherein said sealing element is of slight radial thickness particularly as compared with the radial thickness of said reaction member, said biassing means comprise inflatable tubular members extending for substantially the entire circumferential length of said sealing element.

14. Paper forming roll as defined in claim 1 wherein said shell continuously rotates in a direction passing said forming zone first and thereafter said primary holding zone, said transfer zone, and said secondary holding zone at least in succession during paper forming operation of said cylinder; said second one of said pressure chambers is situated below said first one of said pressure chambers and is separated therefrom by one of said internal walls; and said generally vertical wall extends along one edge of said one of said internal walls with an upper portion thereof partially defining said first one of said pressure chambers and a lower portion partially defining said second one of said pressure chambers.

15. Paper forming roll as defined in claim 1 wherein said secondary holding zone includes means for supplying a low intensity vacuum thereto whereby water in the surface of said shell and said wire passing said transfer zone will be held in said shell and said wire at least until passing beyond said secondary holding zone.

16. Paper forming roll as defined in claim 2, provided with means inside said shell for directing a water spray at said one sealing unit occupying the entire space of said transfer zone.

17. Paper forming roll as defined in claim 1 wherein said plurality of circumferentially extending zones includes a water evacuation zone and a fiber disposal zone following said secondary holding zone in succession, and a third one of said pressure chambers is connected to a source of pressure and includes air exit ports in communication with said water evacuation zone to supply positive pressure air therein for application against said rotatable shell passing thereby to force water outwardly from said shell.

18. Paper forming roll as defined in claim 17 wherein said fiber disposal zone includes a lower end and an upper end with first shower means disposed outside of said shell between said lower end and said upper end of said fiber disposal zone for washing away fiber residue and second shower means disposed within said fiber disposal zone adjacent said upper end thereof for washing down fiber residue not removed by said first shower means and sticking to the inside surface of said shell.

19. Paper forming roll as defined in claim 18 wherein means for receiving and draining water and fibers are disposed adjacent said lower end of said fiber disposal zone for substantially the entire length of said roll.

20. Paper forming roll as defined in claim 19 wherein a baffle is provided in said fiber disposal zone with an upper edge adjacent an area of said fiber disposal zone having maximum radial width and a lower edge inclined radially inwardly from said upper edge and located adjacent said means for receiving and draining water and fibers.

21. Paper forming roll as defined in claim 2 wherein all of said circumferentially extending zones are limited circumferentially by at least two of said radially extending sealing units except for said transfer zone which is limited by said one sealing unit occupying the entire space thereof.

22. Paper forming roll as defined in claim 2 wherein said one sealing unit occupying the entire space of said transfer zone comprises a sealing element, biassing means, a reaction member, and holding means extending radially outwardly from and secured to said pressure box, said reaction member being held in a fixed radial position by said holding means, said sealing element being disposed radially outwardly of said reaction member, means extending radially outwardly from said reaction member cooperating with means extending radially inwardly from said sealing element to limit circumferential movement of said sealing element, said biassing means being disposed between said reaction member and said sealing element on opposite sides of said means limiting circumferential movement of said sealing element, said reaction member also having shoulders at opposite edges thereof in contact with said biassing means to restrict said biassing means within the circumferential expanse of said reaction member.

23. Paper forming roll as defined in claim 22 wherein said sealing element is of slight radial thickness particularly as compared with the radial thickness of said reaction member, said biassing means comprise inflatable tubular members extending for substantially the entire circumferential length of said sealing element.

24. Paper forming roll comprising:

(a) a stationary pressure box;

(b) a generally cylindrical rotatable foraminous shell extending around said box;

(c) paper making wire on the outside surface of said shell;

(d) spacing means extending radially from said box to said shell, said spacing means being secured to said box;

(e) a plurality of circumferentially extending zones including at least a forming zone, a primary holding zone, a transfer zone, a secondary holding zone in which water may be held, and a water release zone defined by said box, said shell, and said spacing means, wherein said spacing means include a plurality of circumferentially spaced, radially extending sealing units, and (f) means engendering free drippage of water, particularly water containing fibers to the lower inner surface of said shell without impinging upon or adhering to the pressure box, located in the primary holding zone, slightly below a first one of said sealing units defining said primary holding zone, extending along one side of said box for substantially the entire length thereof adjacent to the upper portion of said box, and without any portion of said box lying directly therebeneath.

* * * * *